United States Patent [19]

Sanders

[11] 4,436,306

[45] Mar. 13, 1984

[54] EIGHT-SIDED GAME DICE WITH SUIT ATTRIBUTE MARKINGS

[76] Inventor: David M. Sanders, 705 Bay Ave., Capitola, Calif. 95010

[21] Appl. No.: 267,147

[22] Filed: May 26, 1981

[51] Int. Cl.[3] ..... A63F 9/04

[52] U.S. Cl. ..... 273/146

[58] Field of Search ..... 273/146, 138 R

[56] References Cited

U.S. PATENT DOCUMENTS

| | | | |
|---|---|---|---|
| 1,481,628 | 1/1924 | Souza | 273/146 |
| 4,258,919 | 3/1981 | Martelli | 273/146 |

FOREIGN PATENT DOCUMENTS

| | | | |
|---|---|---|---|
| 648549 | 8/1928 | France | 273/146 |
| 1286783 | 1/1962 | France | 273/146 |
| 1524470 | 4/1968 | France | 273/146 |

*Primary Examiner*—Richard C. Pinkham
*Assistant Examiner*—Arnold W. Kramer
*Attorney, Agent, or Firm*—Allston L. Jones

[57] ABSTRACT

A set of five game dice is disclosed, which enables a player to obtain scoring combinations, in a variant of the game of Yacht, which correspond to flushes and straight flushes in the card game of poker. Each die is eight-sided, and carries a unique combination of numerical attribute markings and suit attribute markings, selected from a range of eight numerical values and five suits.

3 Claims, 2 Drawing Figures

EIGHT-SIDED GAME DICE WITH SUIT ATTRIBUTE MARKINGS

BACKGROUND OF THE INVENTION

Conventional dice are small cubical blocks bearing a pattern of dots on each face to indicate a numerical value from one to six. In many popular games, two or more dice are tumbled to produce an essentially random combination of numbers. One such game, using five dice, is known as Yacht, and is also commonly referred to as "Yahtzee", a trademark of the E. S. Lowe Company, Inc.

A Yacht player scores points by throwing the dice to obtain combinations which include sequences of consecutive numerical values, or repeated occurrences of the same numerical value. These combinations correspond closely to hands in the card game of poker, and are usually described in the same terms. Thus, a sequence of consecutive values is called a "straight", while repeated occurrences are called "three of a kind", "four of a kind", and so forth, because the numerical value on the face of a die is analogous to the rank of a playing card.

The analogy to playing cards is not complete, however, because playing cards are marked with a suit as well as a rank. Since standard dice have no attribute analogous to a suit, certain significant card combinations cannot be parallel in Yacht. For example, one significant combination of cards in poker, known as a "flush", consists of any five cards of the same suit. Another, called a "straight flush", is a sequence of consecutively ranked cards of the same suit. Neither flushes nor straight flushes can be achieved in Yacht using conventional dice.

A variant of Yacht can be envisioned in which the dice bear a suit attribute, as well as a ranked numerical attribute, so that flushes and straight flushes are possible. Ideally, the variant would have three additional properties. First, the probability of obtaining a given combination, such as a flush, in any one suit, should be the same as the probability of obtaining a similar combination in any other suit. Second, the dice should be constructed so that each numerical attribute value appears only once on each die, so that the probability of obtaining ordinary straights and repeated values is unaffected by the addition of suit attribute. Third, it is desirable to keep the number of numerical attribute values, and hence, the number of sides on each die, to a minimum, so that the difficulty of obtaining any particular combination is not unduly increased.

One prior art attempt to provide such a variant employed five identical cubical dice, with each face bearing one of three colors and a numerical value. Opposite sides of a die carried the same color, and each color indicated a suit. This scheme permitted simple flushes to be produced, but being identical, the dice could not form a straight flush, since only two numerical values appeared with each color.

Other types of game dice have been designed to substitute for cards in poker, such as those disclosed in U.S. Pat. Nos. 3,608,905 of Edison, 645,112 of Mapes and 614,524 of Yardley. However, the dodecahedral and decahedral shapes suggested in those patents are not optimal for use in a Yacht variant because the large range of rank or numerical attribute values makes each particular combination unnecessarily difficult to obtain.

SUMMARY OF THE INVENTION

In accordance with the preferred embodiments of the present invention, a set of five octahedral dice bear markings to indicate both a suit attribute and a numerical value attribute for each face. Five different suits and eight numerical values are represented on the faces of the dice. The markings are arranged so that both ordinary flushes and straight flushes may be obtained, while the probability of obtaining suit independent combinations is not adversely affected.

DESCRIPTION OF THE PREFERRED EMBODIMENTS

Figure 1A:
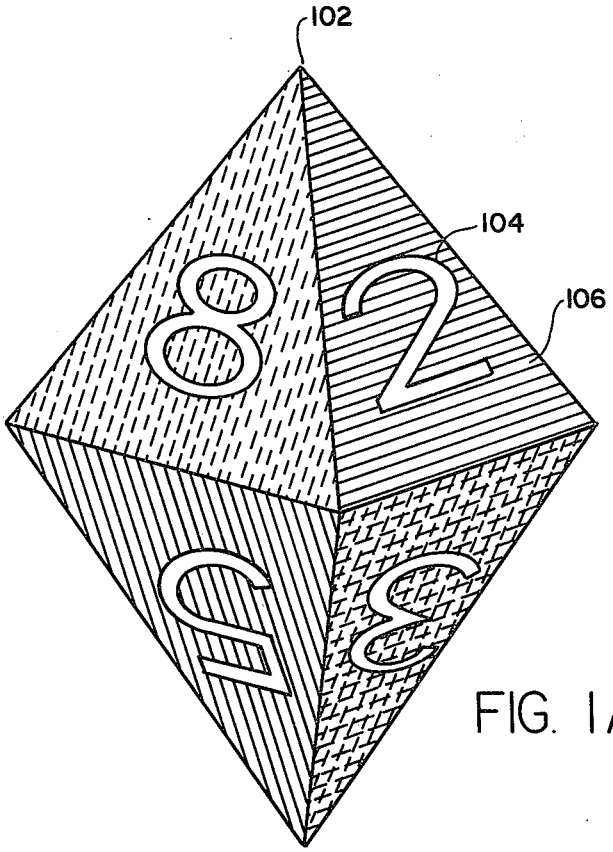
FIGS. 1A and 1B show perspective and top views, respectively, of an eight-sided die bearing numerical value and suit markings.

Referring to FIG. 1A, an eight-sided die 102 carries a numerical attribute marking 104 on a face 106. In the preferred embodiment, die 102 is a regular octahedron, but other eight-sided shapes, such as octahedra with rounded edges or vertices, are also suitable. Numerical attribute marking 104 is preferably in the form of an arabic numeral. Other representations may be used if desired, such as a pattern of dots, a roman numeral, or a letter of the alphabet, provided that each symbol used is selected from a range of eight symbols which clearly indicate a ranked order. Each face of die 102 bears a different numerical attribute marking.

Figure 1B:
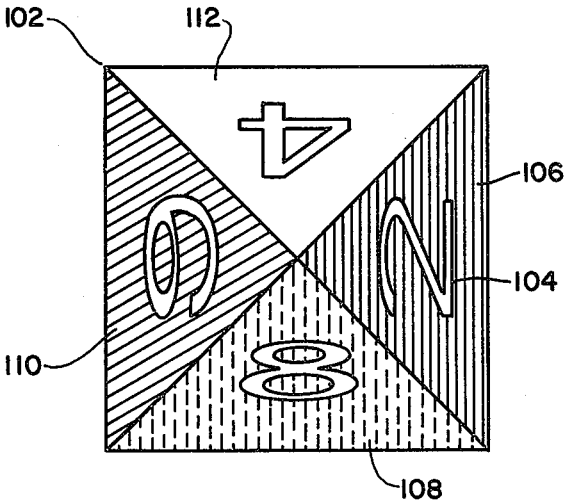

Referring to FIG. 1B, faces 106, 108, 110 and 112 of die 102 are preferably colored to indicate a suit attribute for each face. Alternatively, an additional symbol such as a heart or diamond may be placed on a face to indicate suit, but the marking must be made in a manner which avoids confusion between suit attribute markings and numerical attribute markings. In the preferred embodiment, numerical attribute marking 104 is in a color different from that of face 106 to provide visual contrast.

In the preferred embodiment, five dice are used, each having a different combination of numerical and suit attribute markings. Each of the forty possible combinations of one of the five suit attribute markings with one of the eight numerical attribute markings should appear on exactly one face of the set of five dice. Each die should bear each numerical attribute markings on exactly one face, and each suit should appear at least once but at most twice on each die.

The preferred arrangement of suit attribute and numerical attribute markings is shown in the table below. In the table, the five dice are designated A through E, with the corresponding column of the table showing the combinations of numerical attribute markings (arabic numerals) and suit attribute markings (colors on the faces) placed on the faces of the die.

TABLE

| A | B | C | D | E |
|---|---|---|---|---|
| 1/red | 1/yellow | 1/white | 1/green | 1/blue |
| 2/blue | 2/red | 2/yellow | 2/white | 2/green |
| 3/green | 3/blue | 3/red | 3/yellow | 3/white |
| 4/white | 4/green | 4/blue | 4/red | 4/yellow |
| 5/yellow | 5/white | 5/green | 5/blue | 5/red |
| 6/red | 6/yellow | 6/white | 6/green | 6/blue |
| 7/blue | 7/red | 7/yellow | 7/white | 7/green |
| 8/green | 8/blue | 8/red | 8/yellow | 8/white |

Generally, a suitable scheme may be produced by first selecting a sequence of five suit attribute markings, such as the colors red, blue, green, white, and yellow. Choosing a different starting color for each die, the colors may then be paired in sequence with the numerical values.

The preferred embodiment provides dice which can produce both flushes and straight flushes. In addition, the probability of obtaining a flush in any one suit is the same as in any other suit. Also, since each numerical attribute value appears only once on each die, the probability of obtaining suit independent combinations, such as straights, is not greatly changed from that obtained with conventional dice. The range of numerical attribute values is only eight, so that particular combinations are not made unduly improbable.

An eight-sided die is optimal, not only because of the disadvantages previously discussed for larger numerical attribute ranges, but also because fewer-sided dice cannot achieve the same effects. For example, if the scheme in the table above were adapted to cubical dice, every flush would be a straight flush. In contrast, the preferred embodiment yields flushes of which one-half are straight flushes and one-half are ordinary flushes.

The arrangement of markings in the preferred embodiment has two additional interesting features. First, where one color appears twice on the same die, it is paired with numerical markings which differ in rank by five. This produces a second property, of interest in obtaining straight flushes. If a player has rolled four of the five number-color combinations necessary for a straight flush, any roll of the fifth die which completes the straight will also complete the flush.

To illustrate this straight flush property, suppose that dice A, B, C and D of the table have all landed with the white side up, producing the numerical sequence 4, 5, 6 and 7. Die E, if rolled to either 3 or 8 (completing the sequence as 3, 4, 5, 6, 7, or 4, 5, 6, 7, 8) will also show a white side to complete the flush.

I claim:

1. A set of five game dice, each die having eight faces, each face bearing a numerical attribute marking selected from a range of eight ranked numerical attribute markings and a suit attribute marking selected from a set of five suit attribute markings, the suit attribute and numerical attribute markings for each face being selected so that:

each die bears one each of two of the five suit attribute markings thereon and two each of the remaining three suit attribute markings with the combinations of said two of the five and the combinations of said three of the remaining five suit attribute markings both being of differing combinations on each respective die;

each die bears each numerical attribute marking on exactly one face;

every possible combination of a suit attribute marking and a numerical attribute marking appears on exactly one face of the set of five dice with each of the two numerical attribute markings in the middle of said range of eight ranked numerical attribute markings appearing in combination with said one each of two of the five suit atribute markings on each respective die;

said two numerical attribute markings in the middle of said range of light ranked numerical attribute markings effectively dividing said range into three groups, a first group having the three lowest ranked numerical attributes, a second group having the middle two numerical attributes, and a third group having the three highest ranked numerical attributes; and on each die, any two faces bearing the same suit attribute marking bear numerical attribute markings which occupy the same relative positions within said first and third groups of numerical attributes to permit the throwing of both ordinary and straight flushes.

2. A set of five game dice as in claim 1, wherein each die is a regular octahedron with flat triangular faces.

3. A set of five game dice as in claims 1 or 2, wherein the suit attribute markings are colored regions on the faces.

* * * * *